US012240653B2

(12) United States Patent
Loeckx et al.

(10) Patent No.: US 12,240,653 B2
(45) Date of Patent: Mar. 4, 2025

(54) WIPER PACKAGING DEVICE AND SYSTEM OF A WIPER PACKAGING DEVICE

(71) Applicant: Robert Bosch GmbH, Stuttgart (DE)

(72) Inventors: Joren Loeckx, Kessel-Lo (BE); Dirk Herinckx, Dries-Linter (BE); Mathijs Sinnaeve, Tienen (BE)

(73) Assignee: Robert Bosch GmbH, Stuttgart (DE)

( * ) Notice: Subject to any disclaimer, the term of this patent is extended or adjusted under 35 U.S.C. 154(b) by 55 days.

(21) Appl. No.: 18/309,119

(22) Filed: Apr. 28, 2023

(65) Prior Publication Data

US 2023/0348142 A1 Nov. 2, 2023

(30) Foreign Application Priority Data

May 2, 2022 (DE) ..... 10 2022 204 279.4

(51) Int. Cl.
*B65D 25/10* (2006.01)
*B65D 65/46* (2006.01)

(52) U.S. Cl.
CPC ..... *B65D 25/108* (2013.01); *B65D 65/466* (2013.01)

(58) Field of Classification Search
CPC ..... B65D 5/445; B65D 5/50; B65D 5/5076; B65D 25/10; B65D 25/108; B65D 65/46; B65D 65/466; B65D 77/26; B65D 85/68
USPC ..... 206/335, 476
See application file for complete search history.

(56) References Cited

U.S. PATENT DOCUMENTS 7,614,499 B2 * 11/2009 Muller ..... B65D 5/38 206/335
9,434,503 B2 * 9/2016 Herinckx ..... B65D 5/445
9,611,087 B2 * 4/2017 Jehannet ..... B65D 85/68
11,325,566 B2 * 5/2022 Herinckx ..... B65D 25/108

FOREIGN PATENT DOCUMENTS

WO WO-2010022948 A2 * 3/2010 ..... B65D 25/105

OTHER PUBLICATIONS

Windshield Wiper Connecting packaging (Year: 2010).*

* cited by examiner

*Primary Examiner* — Bryon P Gehman
(74) *Attorney, Agent, or Firm* — Michael Best & Friedrich LLP

(57) ABSTRACT

A wiper packaging device for two wiper blades (10), with an outer packaging (12) is disclosed. It is proposed that a connecting packaging (14) is provided, which is configured to connect the two wiper blades (10) and arrange the two wiper blades (10) in the outer packaging (12) and which comprises two parallel folds (16) that extend along an entire length (38) of the connecting packaging (14), wherein the connecting packaging (14) delimits a through-recess (18).

15 Claims, 2 Drawing Sheets

WIPER PACKAGING DEVICE AND SYSTEM OF A WIPER PACKAGING DEVICE

BACKGROUND

A wiper packaging device for at least two wiper blades, with outer packaging, has already been proposed.

SUMMARY

The invention relates to a wiper packaging device for at least two wiper blades, with outer packaging.

It is proposed that the wiper packaging device comprises at least one connecting packaging, which is configured to connect at least two wiper blades and arrange the wiper blades in the outer packaging and which comprises at least two parallel folds that extend along an entire length of the connecting packaging, wherein the at least one connecting packaging delimits at least one through-recess. The configuration according to the invention of the wiper packaging device can advantageously enable safe transport of the at least two wiper blades. The at least two wiper blades can advantageously be secured and/or fixed in the outer packaging, in particular against slipping. Particularly advantageously, the at least two wiper blades can be protected from damage during transport. The connecting packaging can advantageously prevent wiper blades disposed in a bottom insert from popping out of the bottom insert, for example as a result of the wiper blades rotating when the outer packaging is moved. The wiper blades, in particular the wiper lips of the wiper blades, are thus particularly advantageously held in a particularly well-protected manner.

A "wiper blade" is preferably intended to be understood to mean at least a part, preferably a subassembly, of a windshield wiper. The wiper blade is preferably provided for use on a vehicle. The wiper blade preferably forms a part of the windshield wiper. The wiper blade, in particular as part of the windshield wiper, is preferably configured for cleaning a surface, preferably a surface of a window, preferably a vehicle window on a vehicle. The wiper blade is preferably coupled to a vehicle, preferably a wiper arm drive of the vehicle, for cleaning the window, preferably the vehicle window such as a windshield. An object being provided or configured for a specific function is preferably to be understood to mean that the object fulfils and/or carries out this specific function in at least one application and/or operating state. An "operating state" is preferably intended to be understood to mean a state in which the wiper arm device is ready for a wiping process and/or a wiping operation and/or is in a wiping operation in which a wiper strip unit, preferably the wiper lip, of the wiper blade, in particular the windshield wiper, is preferably guided over a vehicle window and thereby advantageously bears against the vehicle window.

A "wiper packaging device" is in particular intended to be understood to mean a packaging device that packs at least two wiper blades. Packaging is in particular intended to be understood to mean a protective shell, in particular a box, which protects the contents of the packaging from damage and is used only temporarily, in particular during transport and/or storage. The wiper packaging device is preferably provided for securely holding the wiper blades in the packaging device.

The wiper packaging device preferably comprises outer packaging, which is provided to protect the contents of the outer packaging, in particular the wiper blades, from soiling and/or damage. The outer packaging is preferably at least substantially cuboid, in particular to provide secure standing and/or stacking properties. "Outer packaging" is in particular intended to be understood to mean packaging made of cardboard and/or paper and/or an environmentally friendly material, which is configured as outermost packaging and/or as a boundary between the wiper packaging device and the environment. On the end faces, in particular on the smallest side surfaces, the outer packaging comprises outer packaging openings which are at least substantially square.

The at least two wiper blades are preferably connected to one another with the connecting packaging, in particular in a form-locking manner, and/or fixed to one another, in particular held such that they cannot move relative to one another. The connecting packaging is preferably folded and/or bent for fixing the at least two wiper blades. The connecting packaging preferably comprises at least one through-recess, which is provided to receive the at least two wiper blades and in particular hold them such that they cannot move relative to one another. The through-recess is preferably rectangular, in particular with four at least substantially perpendicular boundaries, in particular formed by the connecting packaging. The expression "connecting" is in particular intended to be understood to mean holding and/or holding two objects, such as wiper blades, in position relative to one another. The connecting packaging is preferably provided to secure the wiper blades held in the bottom insert against sliding of the wiper blades in the bottom insert and/or against sliding of the wiper blades out of the bottom insert.

The connecting packaging preferably comprises two parallel folds, in particular two folds, which are provided for folding the connecting packaging along the parallel folds. A "parallel fold" is in particular intended to be understood to mean a shoulder, an edge or a fold in the connecting packaging, which is disposed parallel to an outer edge and/or to the boundary edges of the passage opening and/or to a further parallel fold. Alternatively, a visible and/or punched or slotted or perforated fold mark disposed parallel to an outer edge and/or the boundary edges of the passage opening and/or a further parallel fold is conceivable as well. The folds of the side regions and/or ends which are at least substantially perpendicular, in particular have a smallest angle of more than 45°, preferably lead to a three-dimensional shape of the connecting packaging. The parallel folds, in particular the three-dimensional shape of the connecting packaging, is provided to arrange and/or fix the connecting packaging in the outer packaging in a form-locking manner. The two folded ends preferably respectively lie against the side walls of the outer packaging. The two folded ends of the connecting packaging are preferably folded in the same direction, in particular in a direction facing away from the wiper blades. The parallel folds are preferably disposed parallel to a length of the connecting packaging. The length of the connecting packaging is in particular intended to be understood to mean the extension in the main extension direction. A "main extension direction" of an object is in particular intended to be understood to mean a direction which runs parallel to a longest edge of a smallest geometrical cuboid which just completely encloses the object. The connecting packaging is preferably configured separately from the outer packaging.

It is further proposed that the through-recess is configured as a connecting element receiving region which is provided to receive at least two wiper arm connecting elements of the at least two wiper blades. The at least two wiper blades can advantageously be secured and/or fixed in the outer packaging, in particular against slipping. Advantageously, the at least two wiper blades can be protected from damage during transport. The connecting packaging can particularly advantageously be assembled in a particularly simple manner. The wiper arm connecting elements can particularly advantageously be connected in the outer packaging, in particular with the connecting packaging, for fixing the at least two wiper blades. Each of the at least two wiper blades preferably comprises at least one wiper arm connecting element, which is provided for connecting the wiper blade to a wiper arm, in particular in a form-locking manner. The wiper arm connecting elements preferably comprise an, in particular aerodynamically optimized, convex front side, in particular the outer side, and a concave rear side, in particular inner side. The connecting element receiving region is preferably formed by the through-recess. The connecting element receiving region is preferably at least substantially rectangular. The connecting element receiving region is preferably disposed at least substantially centrally, in particular in the main extension plane of the connecting packaging. In an assembled state, the connecting element receiving region preferably at least partially encloses the at least two wiper arm connecting elements. A "main extension plane" of a structural unit is in particular intended to be understood as a plane which is parallel to a largest side surface of a smallest notional cuboid which just completely encloses the structural unit, and in particular runs through the midpoint of the cuboid.

It is also proposed that the through-recess is provided to fix the at least two wiper arm connecting elements of the at least two wiper blades in a form-locking manner in at least one plane. Packaging material, in particular the amount of material from which the wiper arm connecting elements are made, can advantageously be saved. The at least two wiper blades, in particular the wiper arm connecting elements, can advantageously be fixed in a particularly simple manner, in particular in a form-locking manner. The plane for the form-locking fixing is preferably disposed at least substantially parallel to a main extension direction of the wiper blades. The plane is preferably formed by the main extension direction of the, in particular unfolded, connecting packaging and/or the through-recess and/or the connecting element receiving region. The wiper arm connecting elements of the wiper blades are in particular respectively longer than the through-recess. The through-recess is in particular about twice as wide as one of the wiper arm connecting elements of the wiper blades. Two wiper arm connecting elements taken together are in particular about as wide as the through-recess.

It is further proposed that the at least one connecting packaging is made of the same material as the outer packaging. Advantageously, costs, in particular material and production costs, can be saved. "The same material" is preferably intended to be understood to mean that the material of the connecting packaging is made of at least the same group of materials as the material of the outer packaging. The paper group of materials could be used for the connecting and outer packaging, for example, wherein case then paper and/or paperboard and/or cardboard could be used. The material of the connecting and the outer packaging is preferably identical, in particular made from the same blank.

It is also proposed that the connecting packaging is made of a material which is biodegradable. The connecting and outer packaging can advantageously be disposed of cost-efficiently. The expression "biodegradable" is in particular intended to be understood to mean that microorganisms can break the respective material down into its elementary components, such as carbon, oxygen, hydrogen and other minerals.

It is further proposed that, in an unfolded state, the at least one connecting packaging has an at least substantially rectangular outer contour. Material can advantageously be saved. Costs, in particular material and manufacturing costs, can advantageously be reduced. The expression "unfolded" is in particular intended to be understood to mean that the connecting packaging is viewed laid out as flat as possible and the thickness of the connecting packaging is defined at least substantially by the material thickness. An "outer contour" is intended to be understood to mean the outer boundary, in particular the perimeter, of the connecting packaging. The outer contour, in particular the macroscopic external shape, which is defined at least substantially by the two longest side edges, is preferably rectangular and/or rectangular-shaped. The macroscopic shape in particular excludes small chamfers and/or rounded corners and/or small indentations or similar shapes.

It is also proposed that the at least one through-recess is limited to an at least substantially rectangular outer contour. A form-locking connection can advantageously be produced in a particularly simple manner.

It is further proposed that, parallel to the longitudinal axis of the at least one connecting packaging, the at least one through-recess is limited to a maximum extension which is at least 75% of a maximum extension of the at least one connecting packaging parallel to the longitudinal axis, wherein the at least one through-recess perpendicular to the longitudinal axis of the at least one connecting packaging is limited to a maximum extension, which is at least 50% of a maximum extension of the at least one connecting packaging perpendicular to the longitudinal axis. A particularly stable connecting packaging can advantageously be provided. A "longitudinal axis" is in particular intended to be understood to mean an axis that extends parallel to the main extension direction of the connecting packaging. In the unfolded state, the connecting packaging is in particular mirror-symmetrical to at least one mirror plane, preferably to at least two different mirror planes. The longitudinal axis of the connecting packaging preferably corresponds to the main extension direction of the connecting packaging in the unfolded state. Parallel to the longitudinal axis of the at least one connecting packaging, the through-recess is preferably limited to a maximum extension, which is preferably at least 90%, preferably at least 60% and advantageously at least 50% of a maximum extension of the at least one connecting packaging parallel to the longitudinal axis. Perpendicular to the longitudinal axis of the at least one connecting packaging, the through-recess is preferably limited to a maximum extension, which is preferably at least 75%, preferably at least 60% and advantageously at least 40% of a maximum extension of the at least one connecting packaging perpendicular to the longitudinal axis.

It is also proposed that the at least one through-recess is disposed between the at least two parallel folds. Stability can advantageously be improved. Particularly advantageously, at least two wiper blades can be fixed particularly well. "Between" is in particular intended to be understood to mean that the through-recess, in particular the connecting element receiving region, is bounded in the main extension direction of the connecting packaging on at least two sides by the parallel folds, in particular disposed between and/or adjacent to both parallel folds.

It is further proposed that the at least one through-recess directly adjoins the at least two parallel folds. Stability can advantageously be improved. To delimit the through-recess in the longitudinal direction of the connecting packaging, the two edges preferably transition at least substantially into a respective parallel fold. The parallel folds are preferably created by folding the connecting packaging along the longitudinal axis of the through-recess.

It is also proposed that, in an unfolded state, the at least one connecting packaging has an outer contour with angled corner regions. Assembly of the connecting packaging into the outer packaging can advantageously be simplified. The corner regions of the outer contour are preferably chamfered, in particular with an angle of at least substantially 45° viewed parallel to a longitudinal direction of the connecting packaging, in particular tapering in the longitudinal direction. It is also conceivable that the angle parallel to a longitudinal direction of the connecting packaging is at least 5°, advantageously at least 15° and particularly advantageously at least 30°. The chamfer is preferably created by removing material, in particular by cutting off the corners. Alternatively, it is conceivable that the corners are folded over, in particular by 180° to one of the two sides. The outer contour with angled corner regions is preferably provided to facilitate assembly of the connecting packaging into the outer packaging.

A system comprising a wiper packaging device and comprising at least two packaged wiper blades which each comprise a wiper arm connecting element, wherein the wiper arm connecting elements reach at least partially through the through-recess is proposed as well. The at least two wiper blades can advantageously be held securely. Damage to the at least two wiper blades, in particular by a sudden movement, such as an impact on the outer packaging, can advantageously be prevented. The packaging can advantageously be assembled easily and quickly. The at least two wiper arm connecting elements reaching through the through-recess preferably create a form-locking connection between the at least two wiper arm connecting elements and the connecting packaging. The connecting packaging preferably restricts the direction of movement of the at least two wiper blades in the directions parallel to the main extension direction.

It is also proposed that the two wiper blades are packaged such that rear sides of the respective wiper arm connecting elements are aligned such that they face one another. Assembly can advantageously be simplified. A particularly stable form-locking connection can advantageously be produced. Assembly can advantageously be simplified. A "front side" is in particular intended to be understood to be the side facing the headwind in at least one operating state, in particular the convex side, and the "rear side" is intended to be understood to be the side facing away from the headwind in at least one operating state, in particular the concave side.

The wiper packaging device according to the invention and the system according to the invention are not intended to be limited to the above-described application and embodiment. The wiper packaging device according to the invention and the system according to the invention can in particular comprise a number of individual elements, components and units that deviates from a herein mentioned number in order to fulfill a herein described function. Moreover, for the ranges of values indicated in this disclosure, values lying within the mentioned limits are also intended to be considered disclosed and usable as desired.

BRIEF DESCRIPTION OF THE DRAWINGS

Further advantages will become apparent from the following description of the drawing. The drawing shows an embodiment example of the invention. The drawing, the description and the claims contain numerous features in combination. The person skilled in the art will expediently also consider the features individually and combine them into meaningful further combinations.

The figures show.

DETAILED DESCRIPTION

Figure 1:
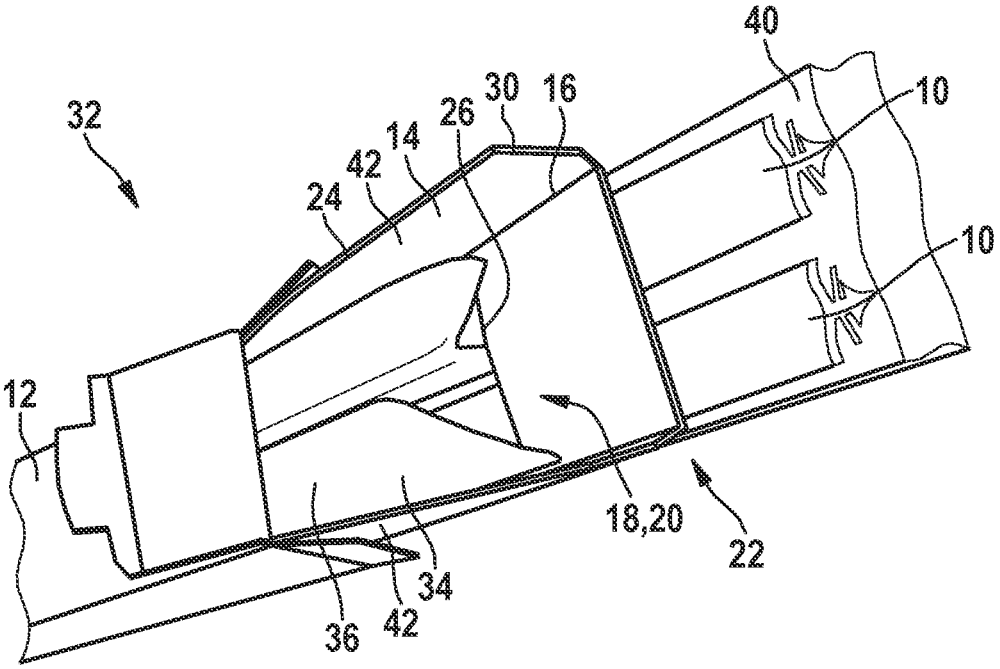
FIG. 1 a schematic perspective view of a system comprising a wiper packaging device and comprising two wiper blades, FIG. 2 a schematic perspective view of outer packaging of the wiper packaging device comprising outer packaging and comprising connecting packaging, and FIG. 3 a schematic plan view onto the unfolded connecting packaging.

FIG. 1 shows a schematic perspective view of a system 32 comprising a wiper packaging device. The system 32 comprises two wiper blades 10. The system 32 comprises a bottom insert 40. The wiper blades 10 are placed into the bottom insert 40. The bottom insert 40 is made of plastic. The bottom insert 40 is made of a biodegradable material. The bottom insert 40 could alternatively also be made of cardboard. The bottom insert 40 is provided to secure the two wiper blades 10 in a form-locking manner against slipping in outer packaging 12 of the wiper packaging device. The bottom insert 40 is provided to protect the wiper blades 10, in particular the wiper lips of the wiper blades 10, from damage during transport. Viewed perpendicular to a main extension plane of the bottom insert 40, the geometrical shape of the bottom insert 40 is at least substantially the same size as a largest side surface of the outer packaging 12, in particular as an underside of the outer packaging 12.

The wiper packaging device comprises the outer packaging 12.

The wiper packaging device comprises a connecting packaging 14. The connecting packaging 14 is provided for holding the wiper blades 10 together. The connecting packaging 14 is provided to hold the wiper blades 10 in respectively intended positions within the outer packaging 12. The connecting packaging 14 is provided to hold the wiper blades 10 in respectively intended positions within the bottom insert 40. The wiper blades 10 each comprise a wiper arm connecting element 34. The connecting packaging 14 is provided to hold the wiper blades 10 relative to one another by means of a form fit with the wiper arm connecting elements 34 of the wiper blades 10. In a packaged state of the system 32, the two wiper arm connecting elements 34 of the wiper blades 10 reach through a through-recess 18 of the connecting packaging 14. Each of the wiper arm connecting elements 34 has a rear side 36. The rear side 36 of the wiper arm connecting element 34 is the side of the wiper arm connecting element 34 which, in a state in which it is properly mounted on a vehicle, is intended to face in an opposite direction to a forward direction of travel of the vehicle. The two wiper blades 10 are connected by the connecting packaging 14 such that the rear sides 36 face toward one another.

Figure 2:
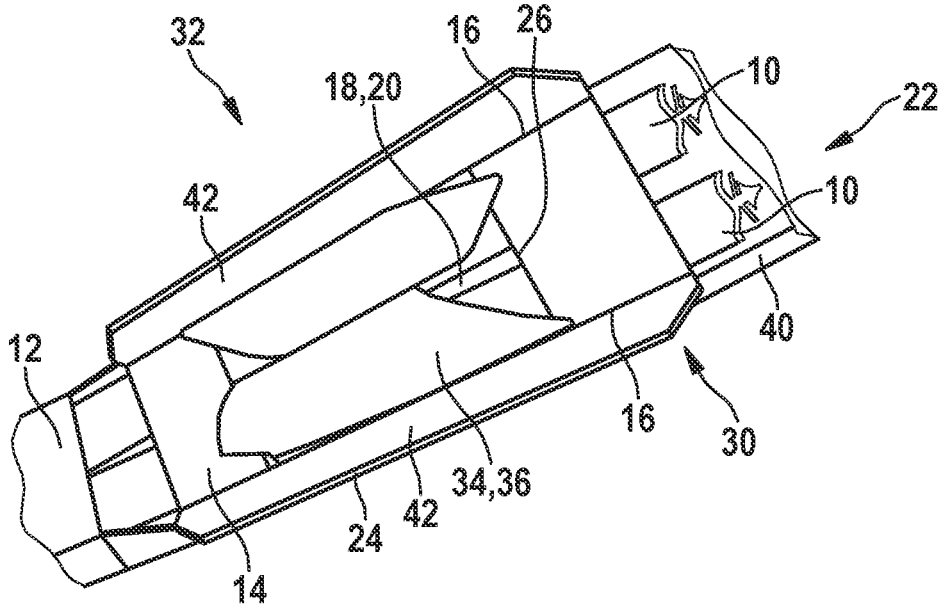

Whereas FIG. 1 shows the system 32 in a state in which the connecting packaging 14 is partially inserted into the outer packaging 12, in FIG. 2 the connecting packaging 14 is still disposed entirely outside the outer packaging 12. The connecting packaging 14 is provided to be disposed in a form-locking manner in the outer packaging 12. In the folded state, the connecting packaging 14 comprises projecting ends 42 of the connecting packaging 14, which are provided to create a form fit with the outer packaging 12. In the folded state, the connecting packaging 14 encloses the wiper arm connecting elements 34 of the wiper blades 10 on three sides. The outer packaging 12 is made of cardboard. The outer packaging 12 could alternatively also be made of a different material. The outer packaging 12 has a cuboid shape. The outer packaging 12 is provided for packaging the two wiper blades 10. The wiper blades 10 and the connecting packaging 14 are inserted into the outer packaging opening on the end face of the outer packaging 12. The outer packaging opening has three closure tabs. The three closure tabs are provided to secure the outer packaging opening in a form-locking manner.

The connecting packaging 14 has an outer contour 24 with angled corner regions 30. The angled corner regions 30 are formed by a chamfer. The angled corner regions 30 are formed by removing material, in particular cutting off the corners. In an alternative embodiment, the angled corner regions 30 could be formed by a fold. The angled corner regions 30 have an angle of 45°. In an alternative embodiment, the angle to the main extension direction of the connecting packaging 14 could be other than 45°. The angled corner regions 30 are provided to facilitate assembly of the connecting packaging 14 into the outer packaging 12.

The angled corner regions 30 serve as an insertion aid for inserting the connecting packaging 14 into the outer packaging 12.

Figure 3:
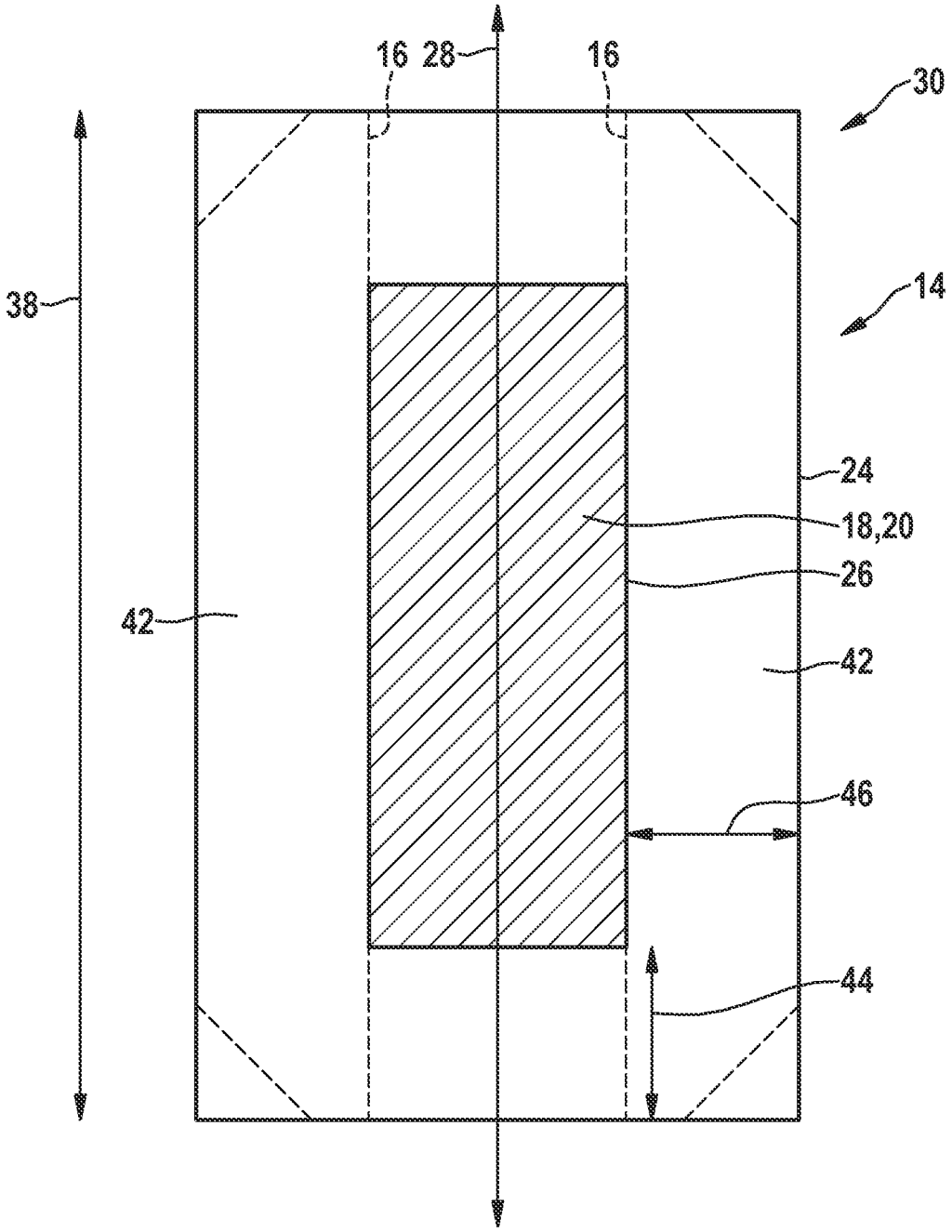

FIG. 3 shows the connecting packaging 14 in an unfolded state in a plan view. The connecting packaging 14 comprises two parallel folds 16. The parallel folds 16 extend along an entire length 38 of the connecting packaging 14. The parallel folds 16 are created by folding the connecting packaging 14. The parallel folds 16 could, however, also be visibly marked. The visible markings of the parallel folds 16 could indicate a fold. The parallel folds 16 could also be formed by a punched hole or a similarly formed perforated fold mark. The projecting ends 42 are created by folding the connecting packaging 14 at the parallel folds 16. In the folded state of the connecting packaging 14, the projecting ends 42 are folded 90° out of a main extension plane of the unfolded connecting packaging 14.

The connecting packaging 14 comprises the through-recess 18. The connecting packaging 14 delimits the through-recess 18. The through-recess 18 is disposed centrally in the main extension plane of the connecting packaging 14. A width 44 of the connecting packaging 14 in the main extension direction of the connecting packaging 14 is the same on both sides of the through-recess 18. A width 46 of the connecting packaging 14 perpendicular to the main extension direction of the connecting packaging 14 is the same on both sides of the through-recess 18. The through-recess 18 forms a connecting element receiving region 20. The connecting element receiving region 20 is provided to receive two wiper arm connecting elements 34. The through-recess 18 is provided to fix the two wiper arm connecting elements 34 in a form-locking manner in a plane 22. The plane 22 is formed parallel to the main extension plane of the connecting packaging 14. The connecting packaging 14 is made of the same material as the outer packaging 12. The connecting packaging 14 is made of a biodegradable material. The biodegradable material is cardboard. However, the biodegradable material could also be a paper or alternatively also a cellulose. It is also conceivable that the biodegradable material is a wood. The material could also be a biodegradable plastic, such as a polylactic acid (PLA).

In the unfolded state, the connecting packaging 14 has an at least substantially rectangular outer contour 24. The through-recess 18 is delimited by a rectangular outer contour 26. The one through-recess 18 is limited to a maximum extent of about 70% parallel to a longitudinal axis 28 of the one connecting packaging 14. The one through-recess 18 is limited to a maximum extent of about 50% perpendicular to the longitudinal axis 28 of the one connecting packaging 14. The one through-recess 18 is disposed between the two parallel folds 16. The two parallel folds 16 transition into the boundary in the longitudinal direction of the through-recess 18. The parallel folds 16 represent an extension of the boundary of the through-recess 18 in longitudinal direction through the connecting packaging 14. The one through-recess 18 directly adjoins the at least two parallel folds 16.

What is claimed is:

1. A wiper packaging device with outer packaging (12), characterized by a connecting packaging (14), which is configured to connect at least two wiper blades (10) and arrange the two wiper blades (10) in the outer packaging (12), wherein the connecting packaging (14) includes a main body having a first end and a second, opposite end spaced from the first end along a length (38) of the connecting packaging (14), wherein the connecting packaging (14) includes a first projecting portion (42) configured to be angled relative to the main body via a first fold (16), and a second projecting portion (42) configured to be angled relative to the main body via a second fold (16), wherein the first and second folds (16) are parallel to one another and extend along an entirety of the length (38) of the connecting packaging (14), wherein the connecting packaging (14) also delimits a through-recess (18) that extends through a portion of the main body, wherein the through-recess (18) is located between the first projecting portion (42) and the second projecting portion (42), wherein the through-recess (18) is spaced from both the first end of the main body and the second end of the main body, and extends less than the entirety of the length (38) of the connecting packaging (14).

2. The wiper packaging device according to claim 1, characterized in that the through-recess (18) is configured as a connecting element receiving region (20) which is provided to receive two wiper arm connecting elements (34) of the two wiper blades (10).

3. The wiper packaging device according to claim 2, characterized in that the through-recess (18) is provided to fix the two wiper arm connecting elements (34) of the two wiper blades (10) in a form-locking manner in a one plane (22).

4. The wiper packaging device according to claim 1, characterized in that the connecting packaging (14) is made of the same material as the outer packaging (12).

5. The wiper packaging device according to claim 1, characterized in that the connecting packaging (14) is made of a material which is biodegradable.

6. The wiper packaging device according to claim 1, characterized in that, in an unfolded state, the connecting packaging (14) has an at least substantially rectangular outer contour (24).

7. The wiper packaging device according to claim 1, characterized in that the through-recess (18) is limited to an at least substantially rectangular outer contour (26).

8. The wiper packaging device according to claim 1, characterized in that, parallel to a longitudinal axis (28) of the connecting packaging (14), the through-recess (18) is limited to a maximum extension which is at least 75% of a maximum extension of the connecting packaging (14) parallel to the longitudinal axis (28), wherein, perpendicular to the longitudinal axis (28) of the connecting packaging (14), the through-recess (18) is limited to a maximum extension, which is at least 50% of a maximum extension of the connecting packaging (14) perpendicular to the longitudinal axis (28).

9. The wiper packaging device according to claim 1, characterized in that the connecting packaging (14) is sized and shaped to be form-fitted into the outer packaging (12).

10. The wiper packaging device according to claim 1, characterized in that the through-recess (18) directly adjoins the first and second at least two parallel folds (16).

11. The wiper packaging device according to claim 1, characterized in that, in an unfolded state, the connecting packaging (14) has an outer contour (24) with angled corner regions (30).

12. A system (32) comprising a wiper packaging device according to claim 1 and comprising two packaged wiper blades (10) which each comprise a wiper arm connecting element (34), wherein the wiper arm connecting elements (34) reach at least partially through the through-recess (18).

13. The system (32) according to claim 12, characterized in that the two packaged wiper blades (10) are packaged in such a way that rear sides (36) of the respective wiper arm connecting elements (34) are aligned such that they face one another.

14. The system (32) according to claim 12, wherein the first projecting portion (42) is angled relative to the main body via the first fold (16), and the second projecting portion (42) is angled relative to the main body via the second fold (16).

15. The system (32) according to claim 14, wherein the first projecting portion (42) is angled relative to the main body at 90 degrees, and the second projecting portion (42) is angled relative to the main body at 90 degrees.

* * * * *